US006849838B2

(12) United States Patent
Shimizu et al.

(10) Patent No.: US 6,849,838 B2
(45) Date of Patent: Feb. 1, 2005

(54) HEATING DEVICE USING ELECTROMAGNETIC INDUCTION AND FUSER

(75) Inventors: Tadafumi Shimizu, Ogori (JP); Shouichi Kitagawa, Fukuoka (JP); Masahiro Samei, Fukuoka (JP); Kazunori Matsuo, Kasuga (JP); Keiichi Matsuzaki, Kurume (JP); Kenji Asakura, Kyoto (JP); Hideki Tatematsu, Ashiya (JP); Yuichi Monda, Kurume (JP); Eiji Torikai, Fukuoka (JP); Kazuhiko Soeda, Kasuga (JP); Tadayuki Kajiwara, Chikushino (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/386,196

(22) Filed: Mar. 11, 2003

(65) Prior Publication Data

US 2004/0035856 A1 Feb. 26, 2004

(30) Foreign Application Priority Data

| | | |
|---|---|---|
| Mar. 11, 2002 | (JP) | 2002-064900 |
| Jul. 11, 2002 | (JP) | 2002-202618 |
| Sep. 12, 2002 | (JP) | 2002-266493 |
| Jan. 31, 2003 | (JP) | 2003-023828 |

(51) Int. Cl.[7] ..... H05B 6/10
(52) U.S. Cl. ..... 219/635; 219/650; 219/672
(58) Field of Search ..... 219/600, 635, 219/645, 650, 651, 659, 660, 661, 672; 399/328, 330, 320

(56) References Cited

U.S. PATENT DOCUMENTS

| | | | | |
|---|---|---|---|---|
| 5,025,489 | A | 6/1991 | Yamaguchi | |
| 5,552,582 | A | 9/1996 | Abe et al. | |
| 6,195,525 | B1 | 2/2001 | Maeyama | |
| 6,278,094 | B1 | 8/2001 | Rindfleisch et al. | |
| 6,668,151 | B2 * | 12/2003 | Uehara et al. | 399/328 |
| 2003/0077093 | A1 * | 4/2003 | Sekiguchi | 399/328 |

FOREIGN PATENT DOCUMENTS

| | | |
|---|---|---|
| JP | 07-295414 | 11/1995 |
| JP | 8-22206 | 1/1996 |
| JP | 09-016006 | 1/1997 |
| JP | 10-074007 | 3/1998 |
| JP | 11/297462 | 10/1999 |
| JP | 2001-188430 | 7/2001 |
| JP | 2001-313162 | 11/2001 |
| JP | 2002-221864 | 8/2002 |

OTHER PUBLICATIONS

Patent Abstracts of Japan, vol. 1996, No. 04, Apr. 30, 1996 & JP 07 319312 A, Dec. 8, 1995, abstract.

* cited by examiner

*Primary Examiner*—Tu Hoang
(74) *Attorney, Agent, or Firm*—Pearne & Gordon LLP

(57) ABSTRACT

A short ring is provided outside a support frame. In the short ring, eddy current is generated in such a direction as to cancel apart of a magnetic flux developed from the exciting coil when it is fed with current, which the part of the magnetic flux leaks to outside. When the eddy current is generated, a magnetic field is developed in such a direction as to cancel the magnetic field by the leaking flux, as taught by Fleming's law. The result is that unnecessary radiation by the leaking flux is prevented, and hence noise generation in other members or devices is suppressed.

22 Claims, 15 Drawing Sheets

HEATING DEVICE USING ELECTROMAGNETIC INDUCTION AND FUSER

BACKGROUND OF THE INVENTION

1. Field of the Invention

The present invention relates to a heating device and a fuser, both using electromagnetic induction, for use in an image forming apparatus of the electrostatic recording type, such as a copying machine, facsimile, and a printer. More particularly, the invention relates to a fuser for fixing a toner image, which is based on electromagnetic induction heating system.

2. Description of the Related Art

Recently, in the image forming apparatus, such as a printer, a copying machine and a facsimile, the market increases demands of energy saving and high speed operation. To meet such market demands, it is important to improve a heating efficiency of the fuser used in the image forming apparatus.

In the image forming apparatus, an unfixed toner image is formed on a recording material, such as recording sheet, printing paper, or electrostatic recording paper, by an image forming process by, for example, xerographic, electrostatic or magnetic recording, and by an image transfer method or a direct method. Examples of widely used fusers for fusing and fixing the unfixed toner images are the fusers of the heating roller type, the film heating type, and the electromagnetic induction heating type.

A fuser of the electromagnetic induction heating type is disclosed in Japanese Unexamined Patent Publication No. H08-22206. In the fuser, eddy current is caused in a magnetic metal member by an alternating magnetic field applied thereto, Joule heat is generated therein by the eddy current, and the heating member including the metal member is induction heated.

The fuser of the electromagnetic induction type is such that a magnetic field is developed by an exciting coil, and eddy current is caused in the surface region of the conductive roller by the magnetic field. The support frame made of resin or the like, located near the conductive roller, is subjected to high temperature. Accordingly, when it experiences a long time use, it is disadvantageously warped.

Further, there is such a problem that noise is generated in members or devices located near the fuser, by unnecessary radiation by leaking magnetic fluxes caused by the exciting coil.

Furthermore, since high voltage is applied to the exciting coil, a housing is provided at the opposite side of the heating member of the induction heating unit to prevent an electric shock. Since the exciting coil etc. located near the heating member is subjected to high temperature, resin material of a flame resisting grade is used for the housing. However, according this structure, the temperature in the induction heating rises, and enamel coated on a wire of the exciting coil melts, and it may cause a short or leak, hence a reliability of fuser is decreased.

SUMMARY OF THE INVENTION

Accordingly, an object of the present invention is to prevent a support frame, made of resin or the like, for storing a conductive roller from being warped.

Another object of the invention is to reduce unnecessary radiation by leaking magnetic fluxes caused by the exciting coil, and hence to lessen the noise influence upon the surrounding.

Still another object of the invention is to provide a fuser with reduced temperature rise of an exciting coil.

To solve the above problems, the present invention involves a heating part for heating a printing medium, a support frame with a storage part for storing the heating part, and a reinforcing unit for reinforcing a portion of the storage part of the support frame, which the portion tends to be warped.

According to another aspect, the invention involves a heating member, an exciting coil, disposed facing the heating member, for heating the heating member by electromagnetic induction, and an annular short ring formed with a metal member.

Detailed Description of the Preferred Embodiment (Image Forming Apparatus)

Figure 1:
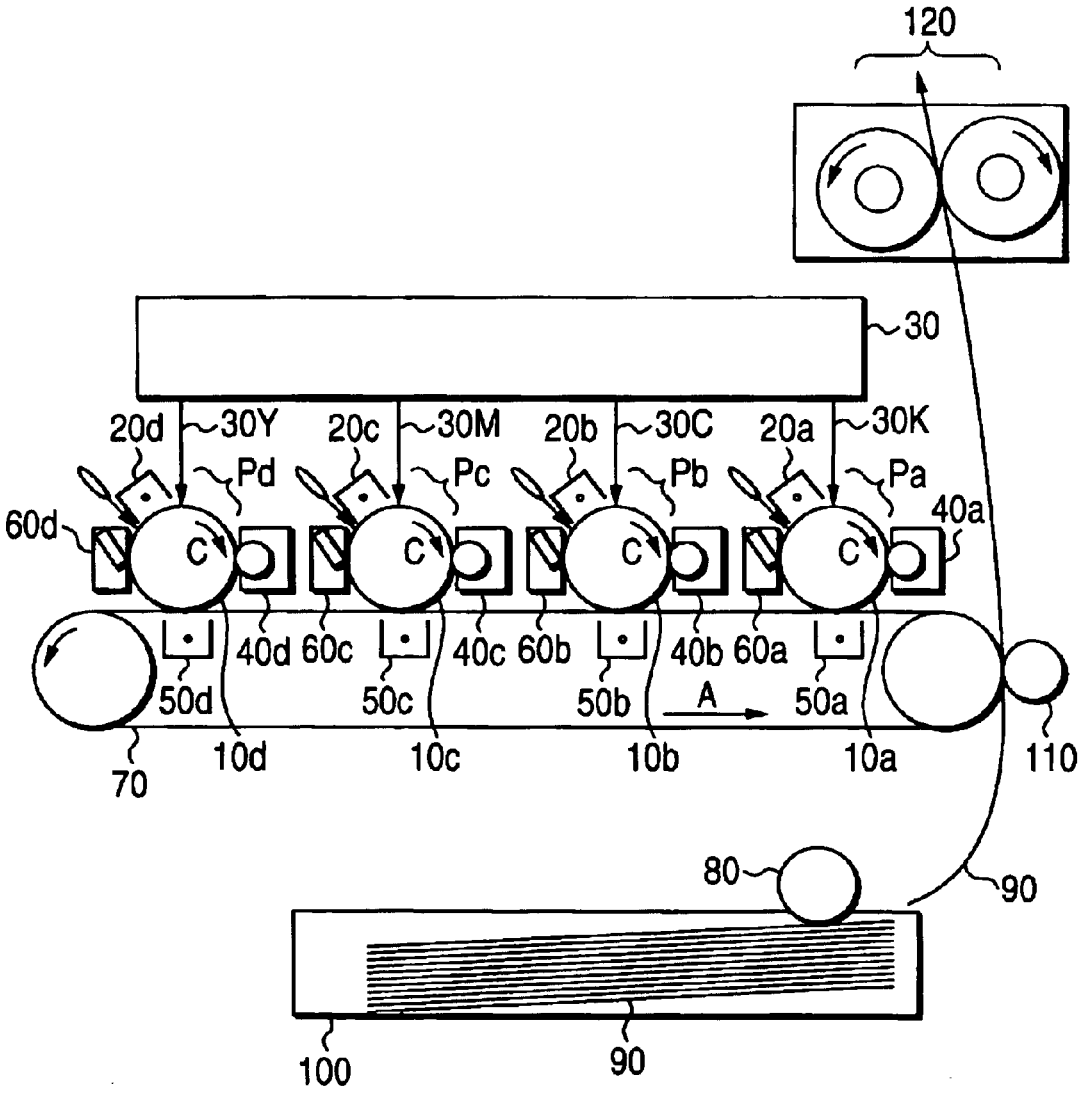
FIG. 1 is an explanatory diagram showing a construction of an image forming apparatus according to an embodiment of the present invention.

FIG. 1 is an explanatory diagram showing a construction of an image forming apparatus according to an embodiment of the present invention. The image forming apparatus discussed in the embodiment is a xerography basis image forming apparatus of the tandem type which includes developing units using color toners of the four fundamental colors, which contribute to the developing of colors in a color images and four color images are superimposed on an image transfer body, and transferred onto a recording material. It should be understood that the invention may be applied to any type of image forming apparatus irrespective of the number of developing units, presence or absence of the intermediate transfer body, and others, in addition to the tandem type of image forming apparatus.

In FIG. 1, a charging unit 20*a* (20*b*, 20*c*, and 20*d*), an exposure unit 30, a developing unit 40*a* (40*b*, 40*c*, and 40*d*), a transfer unit 50*a* (50*b*, 50*c*, and 50*d*), and a cleaning unit 60*a* (60*b*, 60*c*, and 60*d*) are disposed around photo receptor drum 10*a* (10*b*, 10*c*, and 10*d*), respectively. The charging unit 20*a* (20*b*, 20*c*, and 20*d*) uniformly charges a surface of the photo receptor drum 10*a* (10*b*, 10*c*, and 10*d*). The exposure unit 30 emits a scanning line 30K (30C, 30M, and 30Y) of a laser beam, which corresponds to image data of a specific color, onto the charged photo receptor drum 10*a* (10*b*, 10*c*, and 10*d*). The developing unit 40*a* (40*b*, 40*c*, and 40*d*) visualizes an electrostatic latent image formed on the photo receptor drum 10*a* (10*b*, 10*c*, and 10*d*) by developing process. The transfer unit 50*a* (50*b*, 50*c*, and 50*d*) transfers a toner image visualized on the photo receptor drum 10*a* (10*b*, 10*c*, and 10*d*) onto an intermediate transfer belt (intermediate transfer body) 70. The cleaning unit 60*a* (60*b*, 60*c*, and 60*d*) cleans the photo receptor drum 10*a* (10*b*, 10*c*, and 10*d*) by removing toner left on the photo receptor drum 10*a* (10*b*, 10*c*, and 10*d*) after the toner image is transferred from the photo receptor drum 10*a* (10*b*, 10*c*, and 10*d*) onto the intermediate transfer belt 70.

The exposure unit 30 is slanted at a given angle with respect to the photo receptor drum 10*a* (10*b*, 10*c*, and 10*d*). The intermediate transfer belt 70 is rotated in a direction of an arrow A in the illustrated case. A black image, a cyan image, a magenta image and a yellow image are respectively formed in image forming stations Pa, Pb, Pc and Pd. Mono-color images of the respective colors, which are formed on the photo receptor drums 10*a*, 10*b*, 10*c*, and 10*d*, are superimposed one on the others to thereby form a full color image.

A sheet feed cassette 100, which contains sheet materials 90 such as printing papers, is provided in a lower part of the apparatus. The sheet materials 90 are fed out sheet by sheet to a sheet transporting path, from the sheet feed cassette 100 by a paper feed roller 80.

An image transfer roller 110 and a fuser 120 are disposed along the sheet transporting path. The image transfer roller 110 comes in contact with an outer peripheral surface of the intermediate transfer belt 70 over a predetermined area, and transfers a color image from the intermediate transfer belt 70 onto the sheet material 90. The fuser 120 fixes the transferred color image onto the sheet material 90 by heat and a pressure generated when the sheet material 90 is nipped between and rotated by the rollers of the fuser.

In the image forming apparatus thus constructed, a latent image of a black color component in image information is first formed on the photo receptor drum 10*a* by the charging unit 20*a* and the exposure unit 30 in the image forming station Pa. The latent image is visualized into a black toner image by the developing unit 40*a* containing black toner, and transferred, as a black toner image, onto the intermediate transfer belt 70 by the transfer unit 50*a*.

While the black toner image is transferred to the intermediate transfer belt 70, a latent image of a cyan color component is formed in the image forming station Pb, and subsequently it is developed into a cyan toner image by the cyan toner in the developing unit 40*b*. And, the cyan toner image is transferred onto the intermediate transfer belt 7 onto which the black toner image was transferred in the image forming station Pa, by the transfer unit 50*b* in the image forming station Pb, whereby the cyan toner image is superimposed on the black toner image.

Subsequently, a magenta toner image and a yellow toner image are formed in similar manners. When the superimposing of the toner images of four colors on the intermediate transfer belt 70 is completed, those tone images of the four colors are collectively transferred onto the sheet material 90 that is fed from the sheet feed cassette 100 by the paper feed roller 80. The transferred toner image is fused and fixed on the sheet material 90 by the fuser 120, whereby a full color image is formed on the sheet material 90.

(Fuser)

The fuser used in the image forming apparatus of the invention will be described hereunder.

Figure 2:
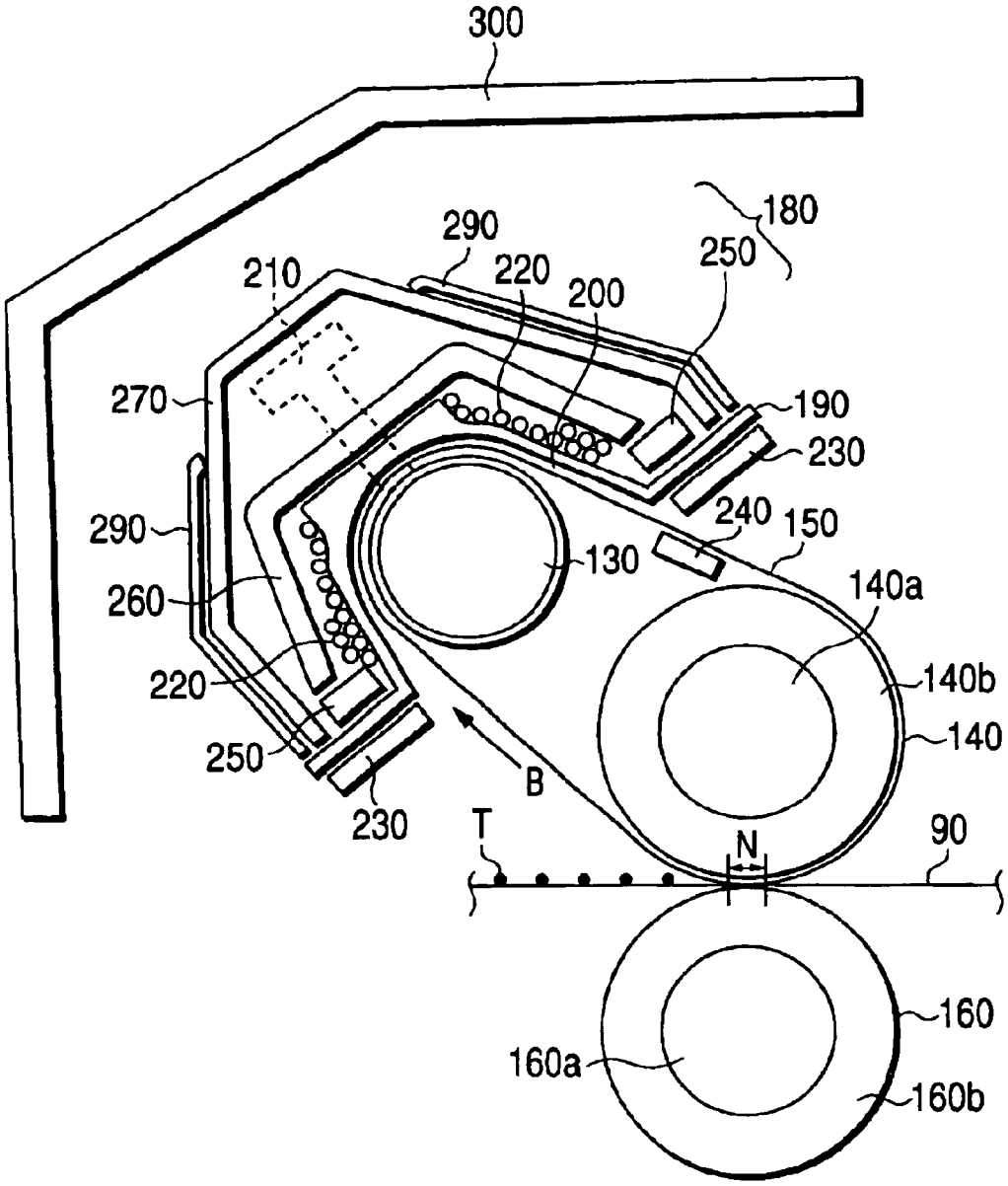
FIG. 2 is an explanatory diagram showing a construction of a fuser for use in the image forming apparatus according to an embodiment of the invention.
Figure 4:
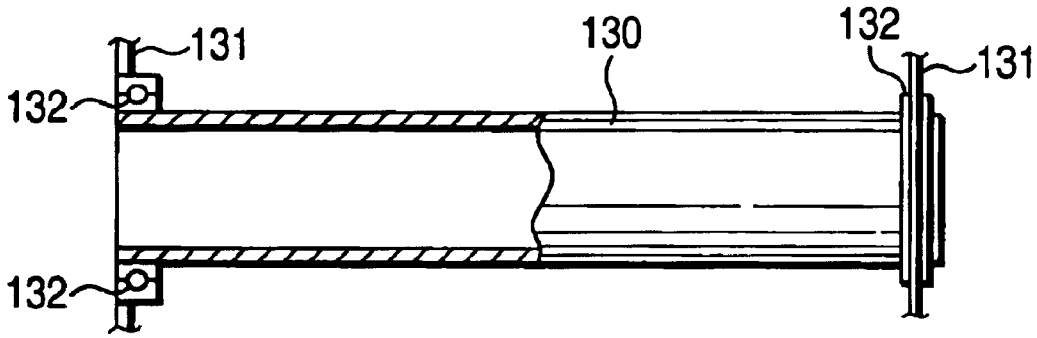
FIG. 4 is an explanatory diagram, partly broken, showing a construction of a heating roller forming the fuser shown in FIG. 2.

FIG. 2 is an explanatory diagram showing a construction of a fuser for use in the image forming apparatus according to an embodiment of the invention. FIG. 4 is an explanatory diagram, partly broken, showing a construction of a heating roller forming the fuser shown in FIG. 2.

The fuser shown in FIG. 2 includes a heating roller 130, a fixing roller 140, a heat resistance belt (toner heating medium) 150, and a pressure roller 160. The heating roller 130 is heated by electromagnetic induction by an induction heating unit 180. The fixing roller 140 is disposed parallel to the heating roller 130. The heat resistance belt 150 as an endless belt is stretched between the heating roller 130 and the fixing roller 140, and heated by the heating roller 130. The heat resistance belt 150 is rotated in a direction of an arrow B by rotation of at least any one of those rollers. The pressure roller 160 is brought into pressing contact with the fixing roller 140 with the heat resistance belt 150 being interposed therebetween, and is rotated in the forward direction with respect to the heat resistance belt 150.

The heating roller 130 is formed with a magnetic metal member, which is made of, for example, iron, cobalt, nickel or an alloy of those metals, and hollowed and cylindrical in shape. The heating roller is 20 mm in outside diameter and 0.3 mm thick, and is low in thermal capacity and high in temperature rising rate.

The heating roller 130, as shown in FIG. 4, is rotatably supported at both ends by bearings 132, which is fixed to a support side plate 131 formed with a galvanized steel plate The heating roller 130 is driven to rotate by a drive unit of the apparatus body, not shown. The heating roller 130 is made of a metallic material of an iron-nickel-chrominum alloy, and is prepared to have a Curie point of 300° C. or higher. The heating roller 130 is shaped like a pile of 0.3 mm thick.

To give a releasability to a surface of the heating roller 130, the heating roller is coated with a release layer (not shown) made of fluororesin and having a thickness of 20 $\mu$m. The release layer may be made of resin or rubber having a good releasability, such as PTFE, PFA, FEP, silicone rubber, and fluororubber, and may also be a mixture of them. These compounds may be employed either alone or as a mixture thereof. When the heating roller 130 is used for fusing the monochromatic image, it is satisfactory to secure only the releasability. When the heating roller 130 is used for fusing the color image, it is desirable to give the heating roller an elasticity. In such a case, it is necessary to form a further thicker rubber layer.

In FIG. 2, the fixing roller 140 includes a core bar 140*a* made of a metallic material, such as stainless steel, and an elastic member 140*b* having a heat resistance property, which covers the core bar 140*a*. In this case, the elastic member 140*b* may be silicone rubber in a solid state or a foamed state. In order to form a contact part (fixing nip part N) of a predetermined width between the pressure roller 160 and the fixing roller 140 by a pressing force from the pressure roller 160, the outside diameters of the pressure roller 160 and the fixing roller 140 are selected to be about 30 mm, larger than that of the heating roller 130.

The elastic member 140*b* of the fixing roller 140 has a thickness of about 3 to 8 μmm and a hardness of, for example, 15 to 50° in Asker hardness (6 to 25° in JIS-A hardness) With this construction, a thermal capacity of the heating roller 130 is smaller than that of the fixing roller 140. Accordingly, the heating roller 130 is heated at high speed, and hence, a warm-up time is reduced.

The heat resistance belt 150 stretched between the exposure unit 30 and the fixing roller 140 is heated when it is in contact with the heating roller 130 heated by the induction heating unit 180. The inner surface of the heat resistance belt 150 is continuously heated by the rotation of the heating roller 130 and the fixing roller 140, so that the belt is entirely heated.

The heat resistance belt 150 is a composite layered belt of a heating layer and a release layer covering the heating layer. The heating layer is made of a magnetic metal, such as iron cobalt, or nickel, or an alloy whose base materials are those metals. The release layer is made of an elastic material, such as silicone rubber or fluororubber.

Where the composite layered belt is used, heat is applied from the induction heating unit 180 to the heat resistance belt 150 through the heating roller 130, and further it is directly applied from the induction heating unit 180 to the heat resistance belt 150 Additional useful effects are that the heating efficiency is improved and the heating response becomes quick.

Even if foreign material enters between the heat resistance belt 150 and the heating roller 130 by some cause, a non-uniformity of temperature distribution is less and hence a reliability of the fusing is increased since the heating layer of the heat resistance belt 150 is heated by electromagnetic induction, and hence the heat resistance belt 150 per se generates heat.

A thickness of the heating layer is preferably within a range from approximately 20 μm to 50 μm, more preferably about 30 μm.

Where the heating layer is made of a magnetic metal, such as iron cobalt, or nickel, or an alloy whose base materials are those metals, if a thickness of the heating layer is larger than 50μm, a distortion stress generated in the belt when it is rotated is large, and the belt may crack by shearing force or a mechanical strength is extremely lowered. If a thickness of the heating layer is smaller than 20 μm, the composite layered belt may suffer from damages, such as crack or breakage, by a thrust load to the belt end generated by a zig-zag motion of the belt at the time of belt rotation.

A thickness of the release layer is preferably within a range from approximately 100 μm to 300 μm, more preferably about 200 μm. If so selected, a toner image T formed on the sheet materials 90 is sufficiently covered with a surface layer of the heat resistance belt 150. Accordingly, the toner image T is uniformly heated and molten.

If the thickness of the release layer is smaller than 100 μm, the thermal capacity of the heat resistance belt 150 is small. A belt surface temperature quickly drops in the toner fixing process, and insufficient fixing performance is secured. If the thickness of the release layer is larger than 300 μm, the thermal capacity of the heat resistance belt 150 is large, and the warm-up time is long. Additionally, the belt surface temperature is hard to drop in the toner fixing process. No cohesion effect of molten toner is produced at the exit of the fuser and, a releasability of the belt is lowered, and attaching of toner to the belt, called a hot offset, occurs.

An inner surface of the heating layer may be coated with resin in order to prevent metal oxidation and to improve the contact performance when it is in contact with the heating roller 130.

The base material of the heat resistance belt 150 may be a resin layer having heat resistance in place of the heating layer made of the metallic material. The resin layer may be made of fluororesin, polyimide resin, polyamide resin, polyamide-imide resin, PEEK resin, PES resin, and PPS resin. Where the resin layer is used, it is advantageous in that the belt is hard to be cracked.

Where the base material is a resin layer made of a high heat-resistance resin, the heat resistance belt 150 is easy to bend according to a curvature of the heating roller 130. Accordingly, heat retained by the heating roller 130 is efficiently transferred to the heat resistance belt 150 Incidentally, the thermal transfer characteristic of the metal is higher than that of the resin layer.

A thickness of the resin layer is preferably within a range from approximately 20 μm to 150 μm, more preferably about 75 μm. If the resin layer is thinner than 20 μm, an insufficient strength to the zig-zag motion of the belt when it is rotated is secured. If the resin layer is thicker than 150 μm, the thermal conductivity of resin is small. As a result, the thermal transfer efficiency from the heating roller 130 to the heat resistance belt 150 is lowered, and the fusing performance is degraded.

Incidentally, when the heat resistant belt 150 includes the heating layer made of a magnetic metal, the heating roller 130 may not include a magnetic metal, and may be made of a non-magnetic metal or an insulating material such as rubber.

Next, the pressure roller 160 is formed with a core bar 160*a* and an elastic member 160*b* provided on the surface of the core bar 160*a*. The core bar 160*a* is cylindrical in shape and made of a metallic material of high heat conduction, such as copper or aluminum. The elastic member is excellent in heat resistance and toner releasability. SUS may be used for the core bar 160*a*, instead of the metal mentioned above.

The pressure roller 160 presses the fixing roller 140 in a state that the heat resistance belt 150 is interposed therebetween, thereby forming a nip part N. In the embodiment, a hardness of the pressure roller 160 is selected to be higher than that of the fixing roller 140. Accordingly, the pressure roller 160 bites into the fixing roller 140 (and the heat resistance belt 150). As a result, the sheet material 90 curves following a circular configuration of the surface of the pressure roller 160. Accordingly, the sheet materials 90 is easy to separate from the surface of the heat resistance belt 150.

The outside diameter of the pressure roller 160 is about 30 mm, equal to that of the fixing roller 140. A thickness of it is about 2 to 5 mm, for example, thinner than that of the fixing roller 140. A hardness of it is about 20 to 60° in Asker hardness (6 to 25° JIS-A hardness)

Construction of the induction heating unit 180 will be described in detail.

As shown in FIG. 2, the induction heating unit 180, which generates a magnetic flux, is disposed while being confronted with an outer peripheral surface of the heating roller 130. The induction heating unit 180 includes a support frame (coil guide member) 190 with a storage space 200 curved to be cylindrical in shape and to cover the heating roller 130 The storage space is for storing the heating roller 130. The support frame 190 is made of a flame-resistant material, such as resin.

A major constituent element of the induction heating unit 180 is an exciting coil 220. The induction heating unit 180 heats the heat resistance belt 150 or the heating roller 130 in the following mechanism. Current is fed to the exciting coil 220. In turn, the exciting coil 220 develops a magnetic flux passing through the hollowed part thereof. The magnetic flux interlinks with the heat resistance belt 150 or the heating roller 130 through the support frame 190. At this time, eddy current is generated at the interlinking part in such a direction as to impede a change of the magnetic flux. By resistance of the heat resistance belt 150 or the heating roller 130, Joule heat is generated in the surface of the heat resistance belt 150 or the heating roller 130.

A thermostat 210 is provided at a position being confronted with the heating roller 130 of the support frame 190. A part of the thermostat 210 for sensing temperature is exposed from the support frame 190 to face the heating roller 130 or the heat resistance belt 150. The thermostat senses temperature of the heating roller 130 and the heat resistance belt 150, and when it senses an abnormal temperature, a power source circuit (not shown) is forcibly turned off.

The exciting coil 220 is formed in such a way that a long exciting coil wire is wound on and along the support frame 190 in an axial direction of the heating roller 130. A width of the winding of the exciting coil 220 is substantially equal to a region where the heat resistance belt 150 is in contact with the heating roller 130.

With such a mechanical arrangement, a region of the heating roller 130 which is induction heated by the induction heating unit 180 is maximized. A time that the surface of the heating roller 130 is in contact with the heat resistance belt 150 is also maximized. Accordingly, an efficiency of transferring heat to the heat resistance belt 150 is also high.

In some of conventional IH basis fusers, the support frame 190 is not used. In such a fuser, if a distance between the exciting coil 220 and the heat resistance belt 150 is not uniform over their width, the following phenomenon occurs. A portion where the distance is small, a flux density is high, so that the IH efficiency is high and the belt temperature is high. A portion where the distance is large, the flux density is low, the IH efficiency is low, and the belt temperature is low.

Accordingly, when a distance between the exciting coil 220 and the heat resistance belt 150 is not uniform over their width, the following disadvantages are present. At a portion where the distance is small, the thermostat 210 operates in a state that the belt temperature is relatively low. Therefore, it will operate at a time point that in a normal state, its operation should be prohibited Accordingly, the reliability is lost, and a faulty state is created. At a portion where the distance is large, the thermostat 210 does not operate until the belt temperature becomes relatively high. Accordingly, it does not operate even at a temperature at which it should operate. This creates the problem of emitting smoke or igniting.

To cope with this, an IH coil is supported by the support frame 190 to maintain the distance between the exciting coil 220 and the heating roller 130 (and the heat resistance belt 150 at a fixed distance over their width. The support frame 190 may be made of resin or a metallic material Use of resin will produce an advantage that the storage space 200 is electrically insulated from the heat resistance belt 150 and the like.

The exciting coil 220 is connected to a drive power source (not shown) including a frequency variable oscillating circuit. The drive power source (not shown) feeds a high frequency current of 10 kHz to 1 MHz, preferably 20 kHz to 800 kHz to the exciting coil, which in turn generates an alternating magnetic field. The alternating magnetic field acts on the heating roller 130 and the heating layer of the heat resistance belt 150 in a contact region where the heating roller 130 is in contact with heat resistance belt 150, and its vicinal region. Eddy current is generated in those components, in such a direction as to impede a change of the alternating magnetic field.

By the eddy current, Joule heat is generated in the heating roller 130 and the heating layer of the heat resistance belt 150, and the amounts of the Joule heat depend on the resistance of them. And, the heating roller 130 and the heat resistance belt 150 are induction heated in a contact region where the heating roller 130 is in contact with heat resistance belt 150, and its vicinal region.

Temperature in the heat resistance belt 150 thus heated is detected by a temperature detecting unit 240, which contains a heat sensing element of good thermal response, such as a thermistor, which is disposed in contact with the inner surface of the heat resistance belt 150 at a position near the entrance of the nip part N shown in FIG. 2.

When the thermistor, presented as one form of the temperature detecting unit 240, detects that temperature of the heat resistance belt 150 exceeds a predetermined temperature value, it produces a signal for transmission to a control circuit (not shown), and in turn the control circuit controls an IGBT to prohibit the current from being fed to the exciting coil 220. When it detects that temperature of the heat resistance belt 150 drops to below a predetermined temperature value, it produces a signal for transmission to the control circuit, and in turn the control circuit controls the IGBT to allow the current to be fed to the exciting coil 220. In this way, the temperature of the heat resistance belt 150 is controlled to be within a predetermined temperature value.

Figure 7:
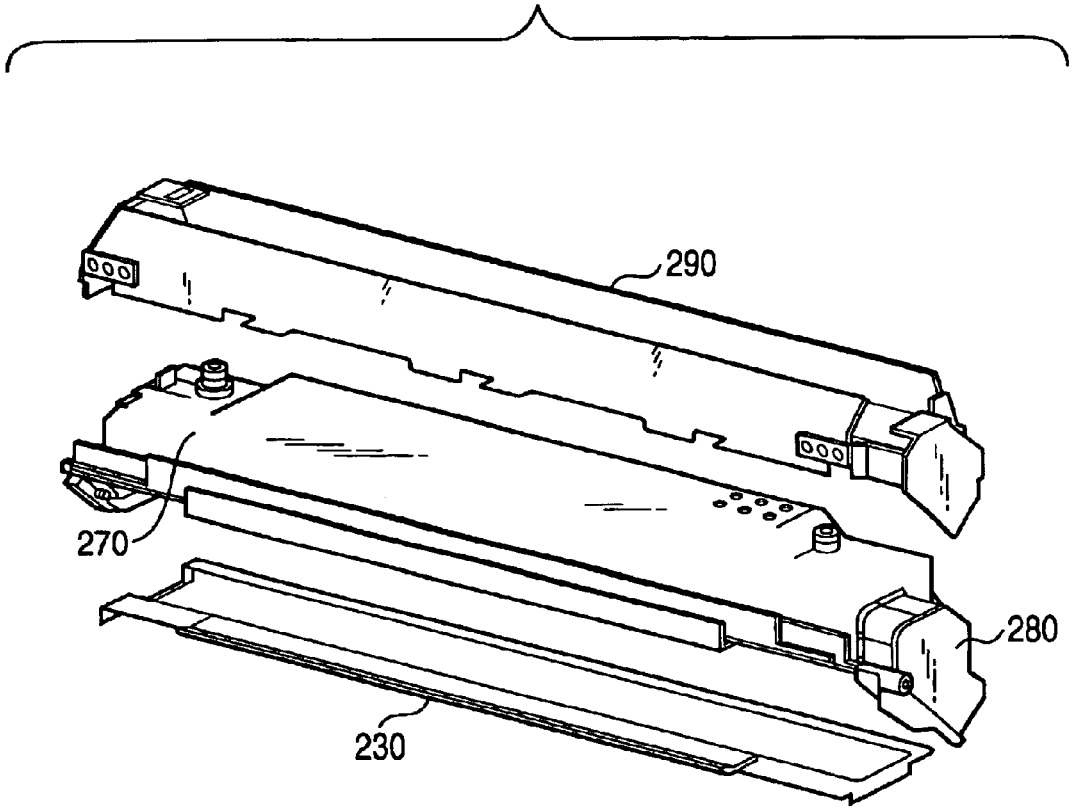
FIG. 7 is an exploded diagram showing a fuser for use in the image forming apparatus according to an embodiment of the invention.

FIG. 7 is an exploded diagram showing a fuser for use in the image forming apparatus according to an embodiment of the invention.

As shown also in FIGS. 2 and 7, a short ring 230 is provided outside of the support frame 190, while surrounding the storage space 200. In the short ring 230, eddy current is generated in such a direction as to cancel a part of a magnetic flux developed from the exciting coil 220 when it is fed with current, which the part of the magnetic flux leaks to outside. When the eddy current is generated, a magnetic field is developed in such a direction as to cancel the magnetic field by the leaking flux, as taught by Fleming's law. The result is that unnecessary radiation by the leaking flux is prevented, and hence noise generation in other members or devices is suppressed.

The short ring 230 may be made of a highly conductive material, such as aluminum or copper.

Figure 3:
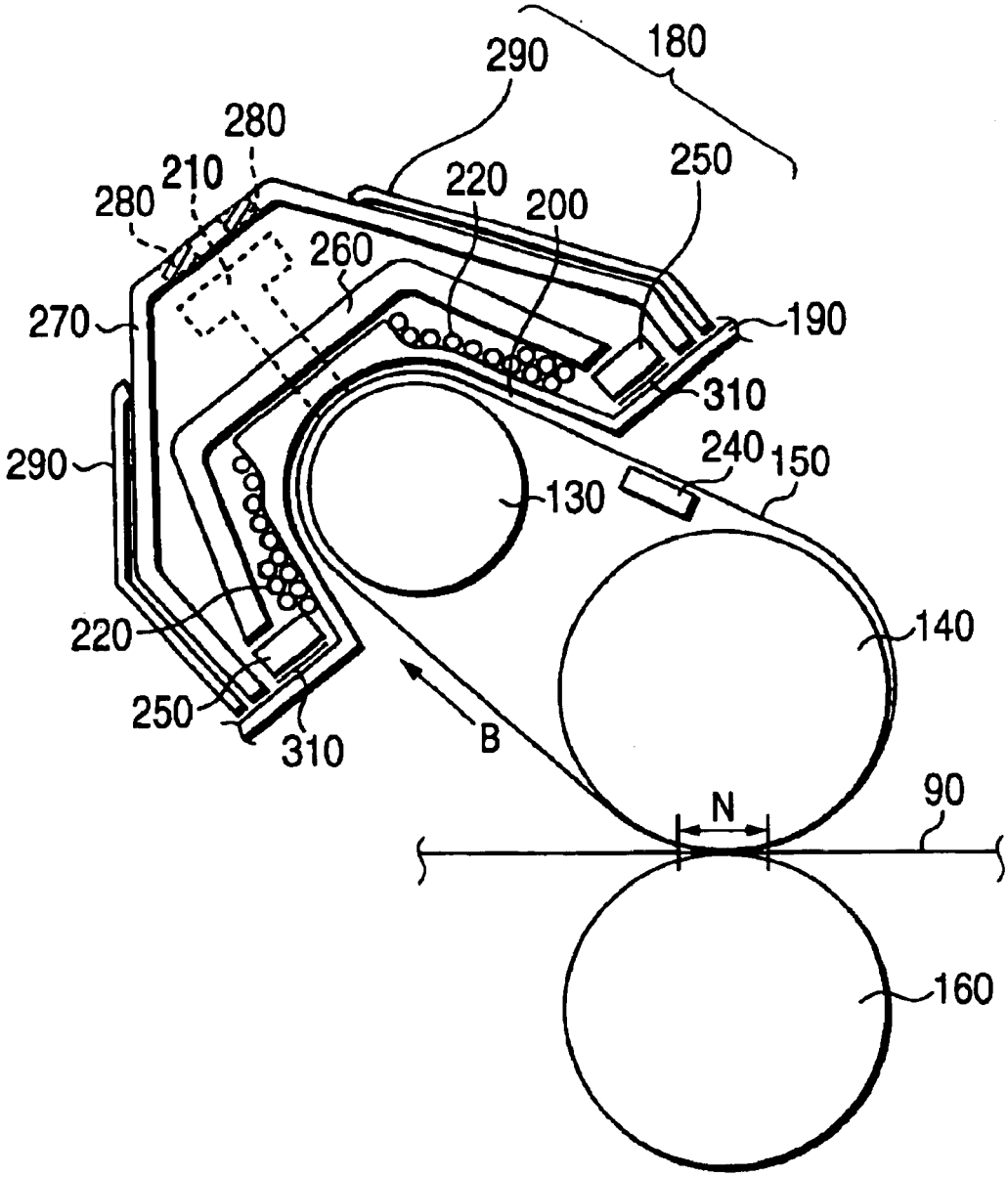
FIG. 3 is an explanatory diagram showing a construction of a fuser for use in the image forming apparatus according to an embodiment of the invention.

FIG. 3 is an explanatory diagram showing a construction of a fuser for use in the image forming apparatus according to an embodiment of the invention. It is satisfactory that a short ring 310 is located at least at such a position as to generate a magnetic flux capable of canceling a leaking flux from the exciting coil 220 to outside. The short ring may be located on the same side as of the exciting coil 220 of the support frame 190, as shown in FIG. 3. Also in case where the short ring thus arranged is used, unnecessary radiation from the exciting coil 220 is effectively reduced, and noise generation in other members or devices is suppressed.

An exciting coil core 250 is provided on the upper side of the short ring 230, while surrounding the storage space 200 of the support frame 190. A C-shaped coil core 260 is provided crossing the storage space 200 of the support frame 190.

As shown in FIG. 2 or 3, use of the exciting coil core 250 and the C-shaped coil core 260 increases an inductance of the exciting coil 220, and a good electromagnetic coupling between the exciting coil 220 and the heating roller 130 can be obtained. Therefore, large electric power can be input to the heating roller 130 at the equal current. Accordingly, a fuser of short warm-up time is realized.

The C-shaped coil core 260 has a width of 10 mm for example, and six C-shaped coil cores are arranged at an interval of 25 mm in the rotary shaft direction of the heating roller 130. The C-shaped coil cores thus arranged are capable of capturing the magnetic flux leaking to outside.

Where the C-shaped coil core 260 is used, the magnetic flux present on the rear side of the exciting coil 220 completely passes through the inside of the C-shaped coil core 260 to thereby prevent the magnetic flux from leaking outside. As a result, conductive members located there around are prevented from being induction heated Further, unnecessary radiation of electromagnetic wave is prevented, and noise generation in other members or devices is suppressed.

A housing 270 is mounted on the support frame 190, and is shaped like a roof covering the C-shaped coil core 260 and the thermostat 210. A material of the housing 270 is preferably a resin, and when the necessity arises, it may be another material.

A plurality of holes 280 are bored in an upper part of the housing 270. Those holes allow heat emitted from the support frame 190, the exciting coil 220, the C-shaped coil core 260 and the like which are located within the housing, to escape outside.

Figure 5:
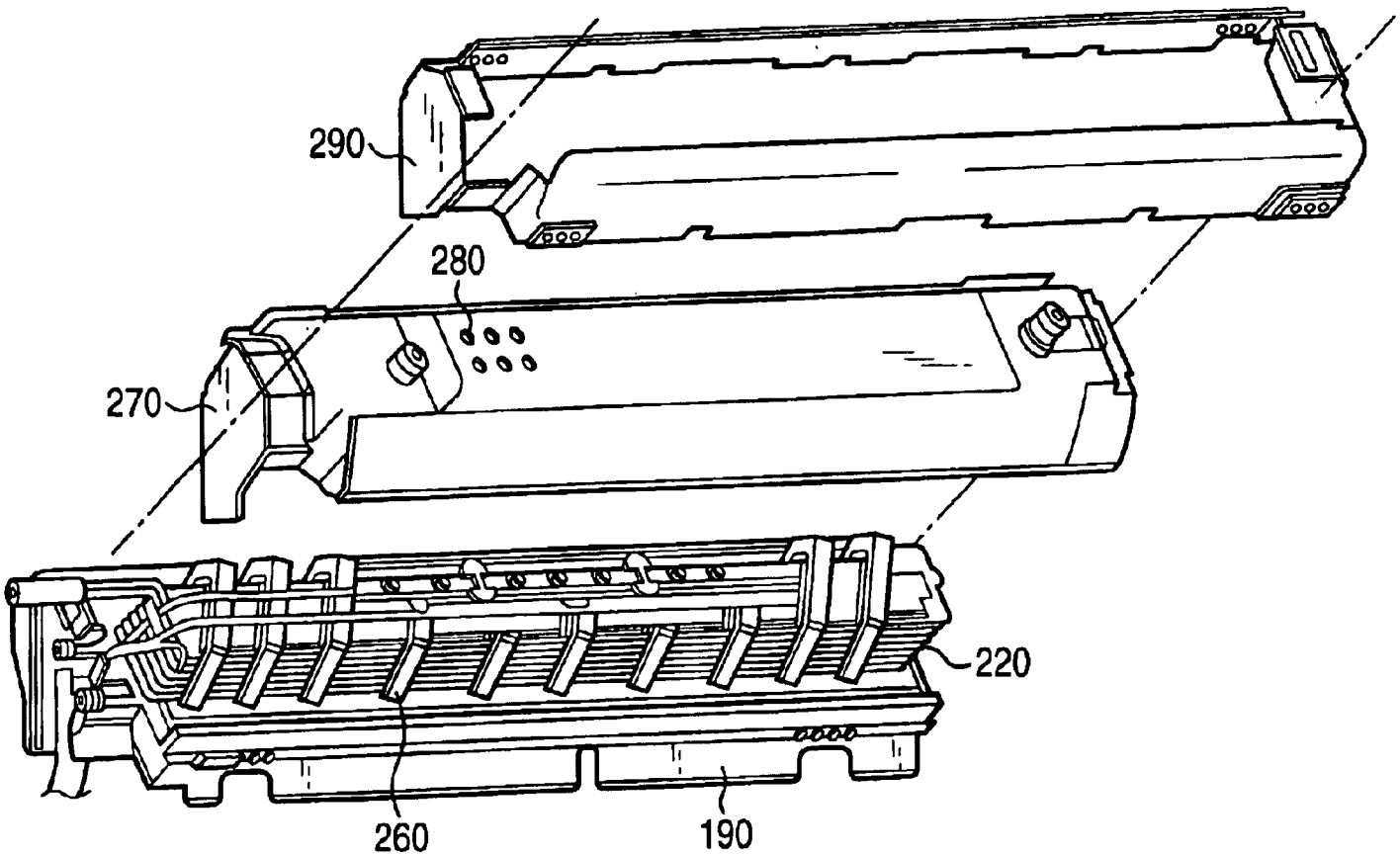
FIG. 5 is a perspective view showing a fuser for use in the image forming apparatus according to an embodiment of the invention.
Figure 6:
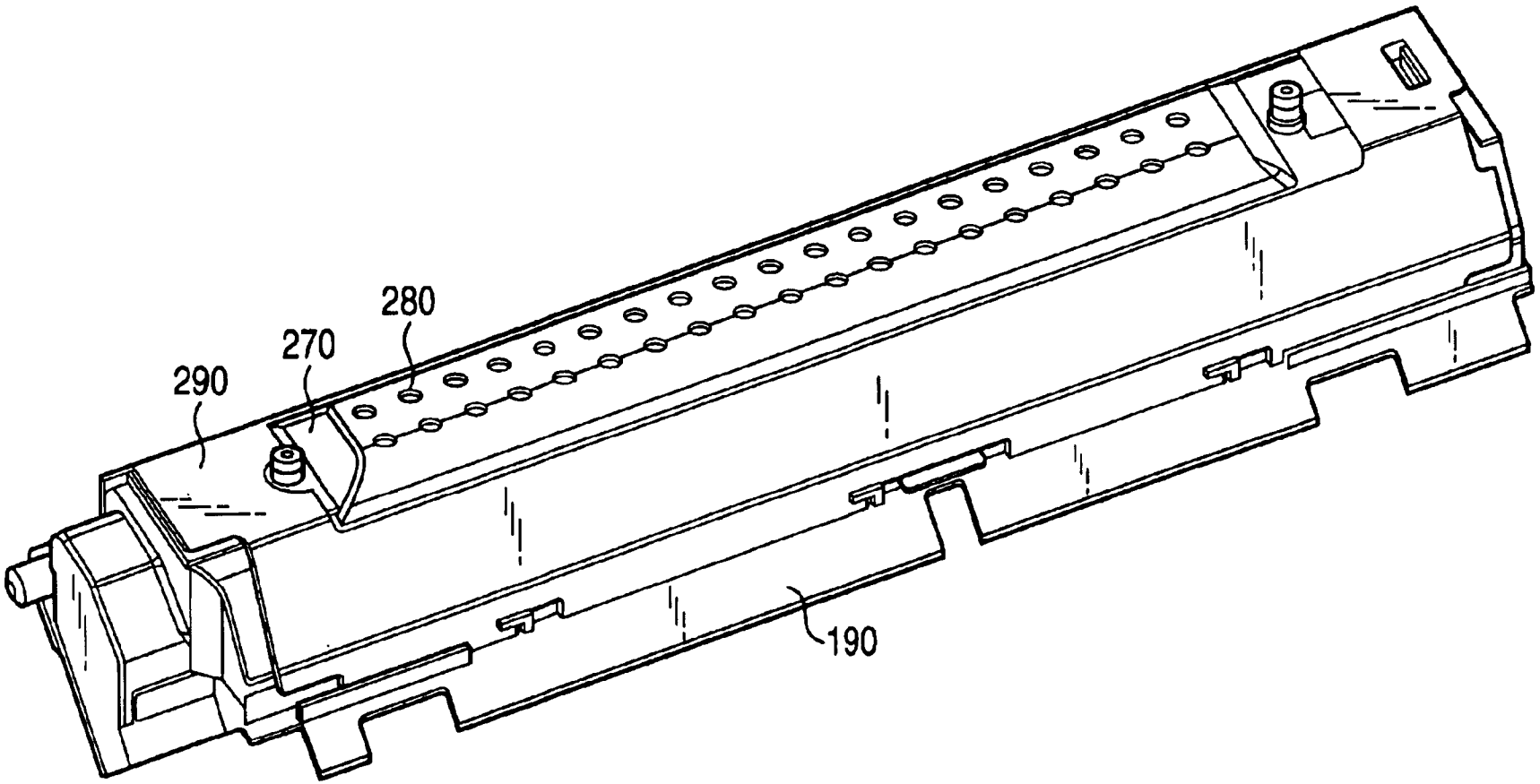
FIG. 6 is a perspective view showing an outward appearance of a fuser for use in the image forming apparatus according to an embodiment of the invention.
Figure 13:
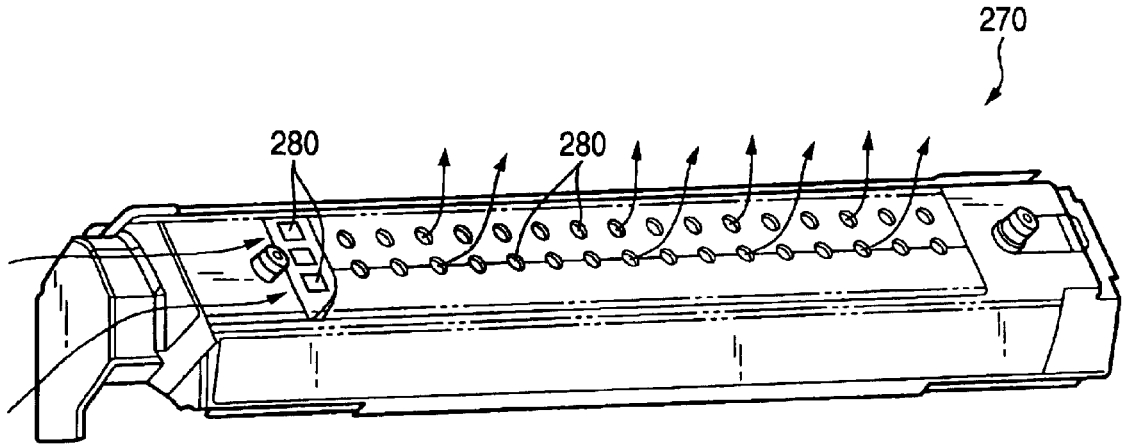
FIG. 13 is a perspective view showing a housing for use in an image forming apparatus according to an embodiment of the invention.

The holes 280 may be bored in an entire upper part of the housing 270 as shown in FIG. 6, alternatively, may be bored in a part of the upper part of the housing 270 as shown in FIG. 5. Further, as shown in FIG. 13, the holes may be provided in a side face of the housing 270 in the longitudinal direction in addition to the upper part. Preferably, an air sending unit such as a fan (not shown) may be provided. By using the air sending unit, air is introduced from the holes 280 to the inside of the housing 270, and the introduced air is released from the holes 280 to the outside of the housing 270. Accordingly, heat can be discharged effectively.

A short ring 290 is mounted on the support frame 190, with its shape so as to cover the housing 270. Further, an upper part of the short ring, which faces the holes 280, is opened so as not to close the holes 280 formed in the upper part of the housing 270.

The short ring 290 is similar to the short ring 230 already stated, and is disposed on the rear side of the C-shaped coil core 260 and the like. Eddy current is generated in the short ring 290 such that the eddy current is directed so as to cancel small leaking flux leaking to outside from the rear side of the C-shaped coil core 260 and the like, and a magnetic field having such a direction as to cancel the leaking flux is developed from the short ring. As a result, unnecessary radiation by the leaking flux is prevented, and noise generation in other members or devices is suppressed.

When temperature of the exciting coil 220 is high, a portion of the support frame 190, which faces the exciting coil 220, is warped. The warping of the support frame occurs not only at the stage of heating the exciting coil but also at the molding stage of the support frame 190. The short ring 290 prevents or eliminates the warping of the support frame 190, and is made of a hard material, such as aluminum.

A shielding plate 300 is provided on the side opposite to the heating roller 130 with respect to the exciting coil 220.

The shielding plate 300 is made of a ferromagnetic metal, such as iron. The shielding plate blocks magnetic fluxes leaking from the rear side of he C-shaped coil core 260 and the like, whereby unnecessary radiation is prevented, and hence noise generation in other members or devices is suppressed.

FIG. 5 is a perspective view showing a fuser for use in the image forming apparatus according to an embodiment of the invention. In FIG. 5, the short ring 290 is mounted on the support frame 190, with its shape so as to cover the housing 270. Further, an upper part of the short ring 290, which faces the holes 280, is opened so as not to close the holes 280 formed in the upper part of the housing 270.

The exciting coil 220 is formed such that an outer surface defining the storage space 200 (FIG. 3), located at the central part of the support frame 190, is wound by an exciting coil wire by plural turns. C-shaped coil cores 260 are provided outside the exciting coil 220. A width of each C-shaped coil core 260 is approximately several millimeters to 10 mm, The C-shaped coil core 260 is mounted covering the exciting coil 220 with its C-like shape. Plural C-shaped coil cores 260 are arranged side by side in the longitudinal direction of the exciting coil 220 as shown in FIG. 2. The thus arranged C-shaped coil cores 260 are superior to the single plate-like core in weight saving. Further, diverging of a magnetic flux developed by the exciting coil 220 when it is fed with current is suppressed to thereby reduce the leakage of magnetic fluxes. Additionally, noise generation in other members or devices is suppressed.

FIG. 6 is a perspective view showing an outward appearance of a fuser for use in the image forming apparatus according ring 290 and the housing 270, which were described referring to FIG. 4, are applied to the support frame 190.

As described above, the housing 270 is shaped like a roof and mounted to cover the support frame 190. A plurality of holes 280 are bored in an upper part of the housing 270, and allow heat to escape out of the housing.

Eddy current is generated in the short ring 290 such that the eddy current is directed so as to cancel leaking flux, and a magnetic field having such a direction as to cancel the leaking flux is developed from the short ring. As a result, unnecessary radiation by the leaking flux is prevented, and noise generation in other members or devices is suppressed. Further, an upper part of the short ring 290, which faces the holes 280, is opened so as not to close the holes 280 formed in the upper part of the housing 270.

Next, how the short rings 230 and 290 to cancel the leaking flux and how the shielding plate 300 blocks the magnetic flux will be described with reference to FIGS. 8 to 12.

Figure 8:
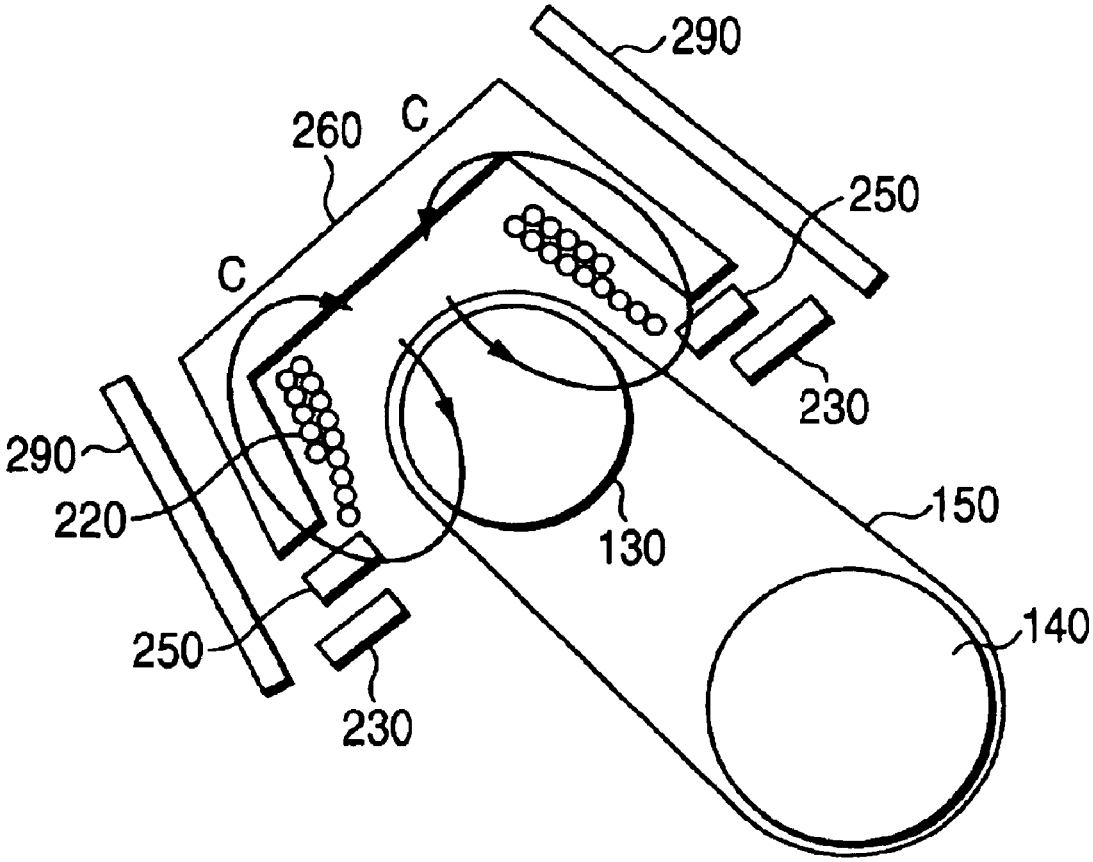
FIG. 8 is an explanatory diagram explaining a distribution of magnetic fluxes developed by induction heating unit according to an embodiment of the invention.
Figure 9:
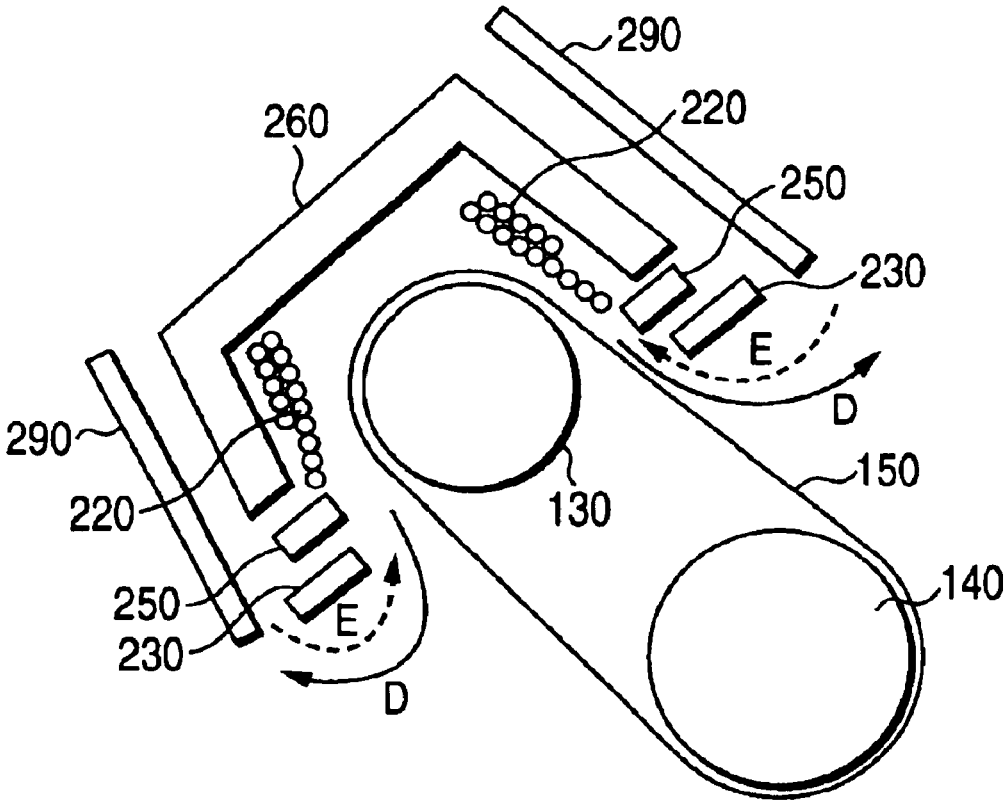
FIG. 9 is an explanatory diagram explaining how magnetic fluxes are canceled by a short ring of the induction heating unit according to the embodiment of the invention.
Figure 10:
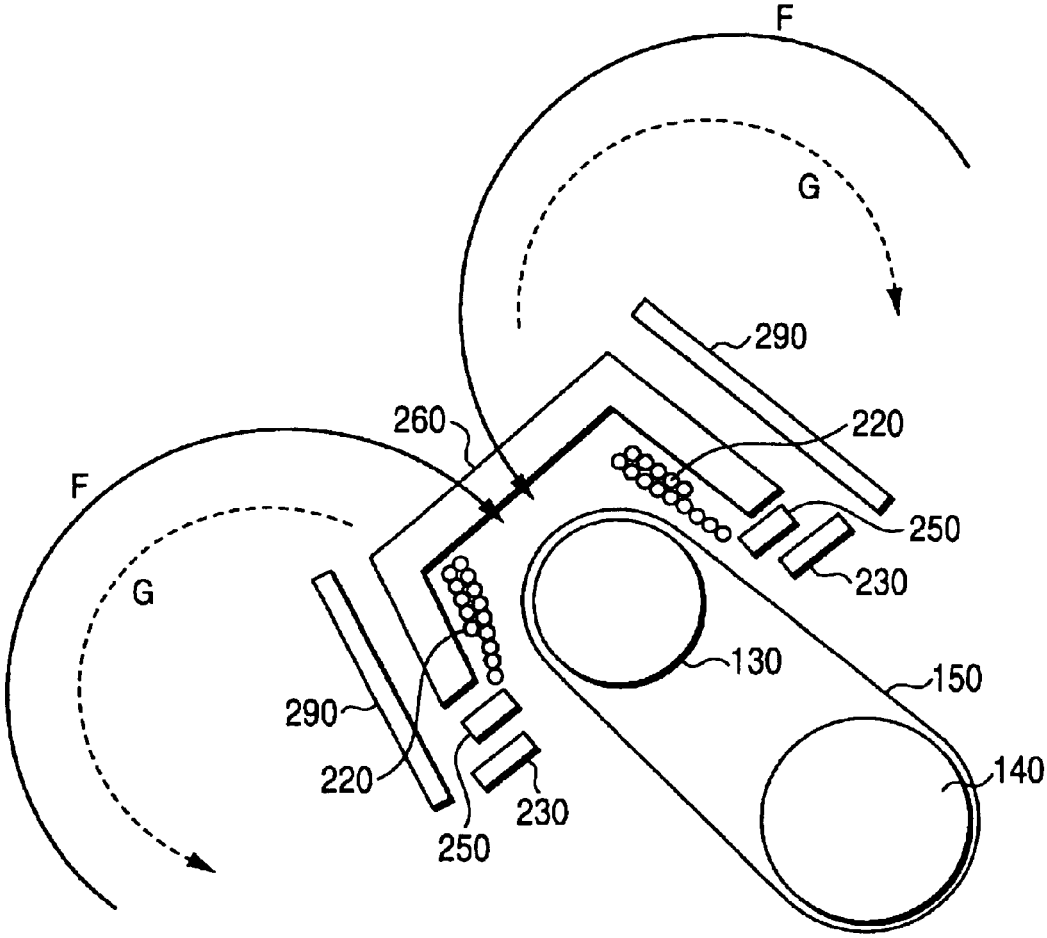
FIG. 10 is an explanatory diagram explaining how magnetic fluxes are canceled by another short ring of the induction heating unit according to the embodiment of the invention.
Figure 11:
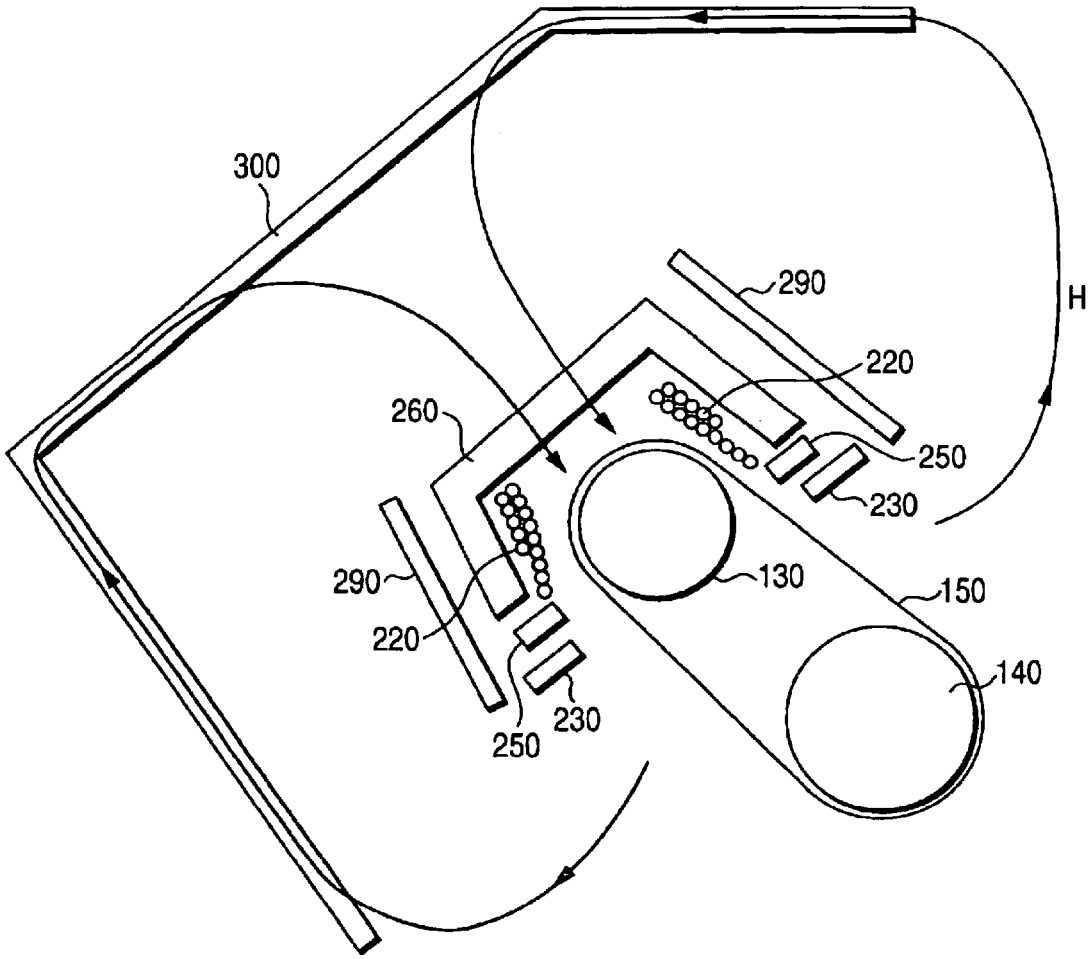
FIG. 11 is an explanatory diagram explaining how a shielding plate of the induction heating unit according to the embodiment of the invention change the magnetic flux distributions.

FIG. 8 is an explanatory diagram explaining a distribution of magnetic fluxes developed by an induction heating unit according to an embodiment of the invention. FIG. 9 is an explanatory diagram explaining how magnetic fluxes are canceled by a short ring of the induction heating unit according to the embodiment of the invention. FIG. 10 is an explanatory diagram explaining how magnetic fluxes are canceled by another short ring of the induction heating unit according to the embodiment of the invention. FIG. 11 is an explanatory diagram explaining how a shielding plate of the induction heating unit of the embodiment of the invention change the magnetic flux distributions. Of the constituent components in those figures, those components already described referring to FIG. 2 and others will be designated by like reference numerals, for simplicity.

As indicated by arrows C in FIG. 8, magnetic fluxes developed by the exciting coil 220 when it is fed with an AC current from an exciting circuit (not shown), pass through the heating roller 130 in substantially circumferential directions since the heating roller 130 is magnetic, while alternately appearing and disappearing. Current induced in the heating roller 130 by variations of the magnetic fluxes flows through only the surface region of the heating roller 130 by the skin effect, and by resistance of the heating roller 130, Joule heat is generated in the heating roller.

The magnetic fluxes, which have passed through the heating roller 130 in the circumferential direction, pass through the interior of the cylindrical part, and enter the heating roller 130 again, and pass through a magnetic path formed by the exciting coil core 250 and the C-shaped coil core 260.

Not all the magnetic fluxes flow into the heating roller and contribute to heat the heating of the roller, but some of the magnetic flux leaks out of the heating roller.

As shown in FIG. 9, the short ring 230 is provided near a position where the magnetic fluxes (indicated by solid lines D), which have passed through the hollowed part of the exciting coil 220 and through the heating roller 130, leak out to outside. The short ring 230 is made of a highly conductive material, such as aluminum or copper. Accordingly, magnetic fluxes (indicated by dotted lines E) are developed in such directions as to cancel the leaking magnetic fluxes, whereby unnecessary radiation by the leaking magnetic fluxes is prevented, and noise generation in other members or devices is suppressed.

As shown in FIG. 10, leaking magnetic fluxes (indicated by solid lines F) leaks to the rear side of the C-shaped coil core 260, from the C-shaped coil core 260 and the like. The short ring 290 develops magnetic fluxes (indicated by dotted lines G) in such directions as to cancel the leaking magnetic fluxes. Therefore, unnecessary radiation by the leaking magnetic fluxes is prevented, and noise generation in other members or devices is suppressed.

As shown in FIG. 11, the shielding plate 300 forms a closed magnetic path so as to prevent the magnetic fluxes (indicated by solid lines H) leaking from the exciting coil 220 to the rear side of the C-shaped coil core 260 and the like from leaking to outside With this, unnecessary radiation by the leaking magnetic fluxes is prevented, and noise generation in other members or devices is suppressed.

The short rings 230 and 290, and the shielding plate 300 are capable of exhibit the flux leakage prevention function independently. However, if those are combined, unnecessary radiation by the leaking magnetic fluxes is more suppressed, and noise generation in other members or devices is suppressed.

Figure 12:
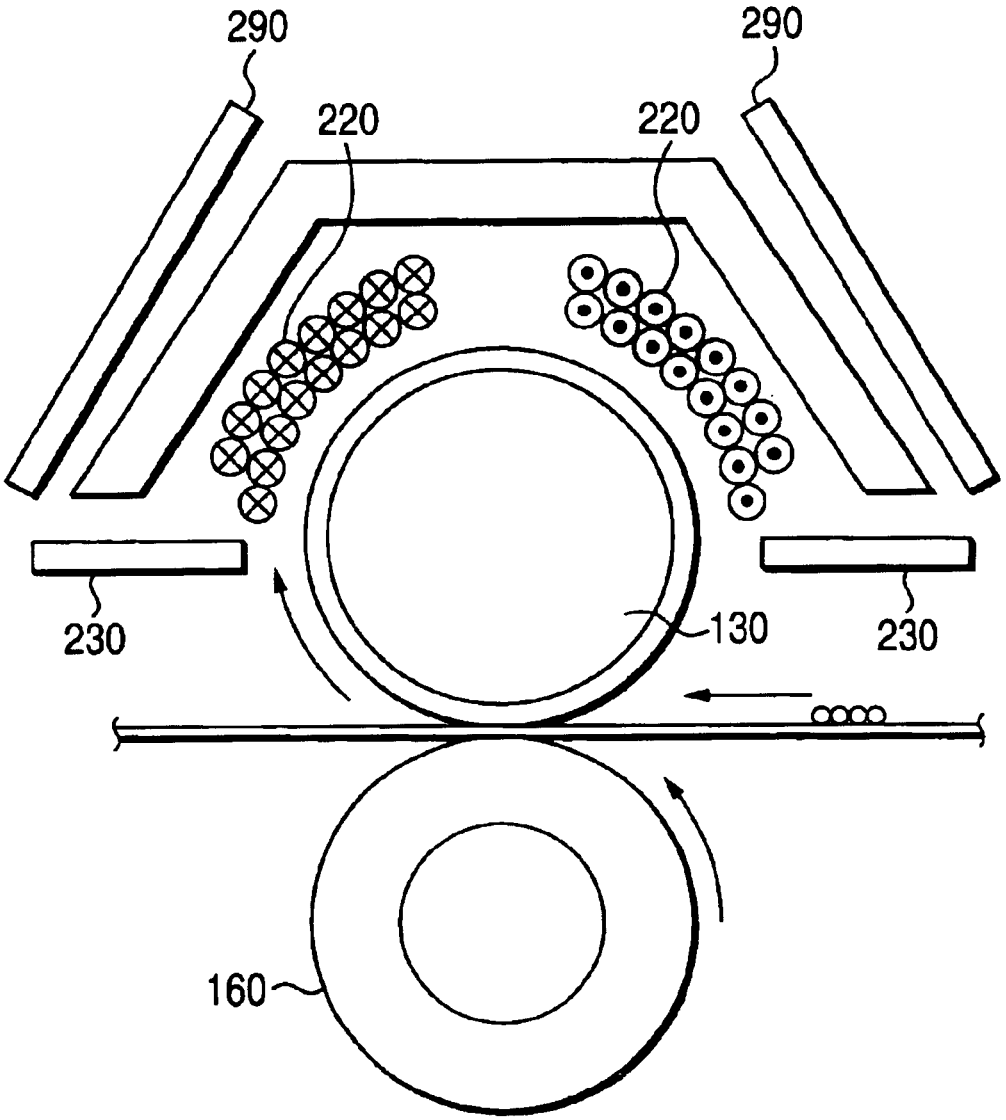
FIG. 12 is an explanatory diagram showing a construction of a fuser for use in the image forming apparatus according to another embodiment of the invention.

FIG. 12 is an explanatory diagram showing a construction of a fuser for use in the image forming apparatus according to another embodiment of the invention.

While in the fuser described referring to FIG. 2, the induction heating unit constructed according to the invention is applied to the fuser of the type in which the image fixing is carried out using the heat resistance belt 150, it is readily understood that, as shown in FIG. 12, the induction heating unit incorporating the unnecessary radiation measure may also be applied to a fuser which does not use the belt.

Reference numeral 130 indicates a heating roller as a heating member. The heating roller 130 is driven to rotate by a drive unit (not shown) of the apparatus body. The heating roller 130 is made of a metallic material of an iron-nickel-chrominum alloy, and is prepared to have a Curie point of 300° C. or higher. The heating roller 130 is shaped like a pipe of 0.3 mm thick.

To give a releasability to a surface of the heating roller 130, the heating roller is coated with a release layer (not shown) made of fluororesin and having a thickness of 20 $\mu$m. The release layer may be made of resin or rubber having a good releasability, such as PTFE, PFA, FEP, silicone rubber, and fluororubber. These compounds may be employed either alone or as a mixture thereof. When the heating roller 130 is used for fusing the monochromatic image, it is satisfactory to secure only the releasability. When the heating roller 130 is used for fusing the color image, it is desirable to give the heating roller an elasticity. In such a case, it is necessary to form a further thicker rubber layer.

Reference numeral 160 designates a pressure roller. The pressure roller 160 is made of silicone rubber having hardness of 65° in JIS-A hardness, and presses the heating roller 130 by a pressing force of 20 kgf, for example, to thereby form a nip part. In the pressing state, the pressure roller 160 rotates with rotation of the heating roller 130.

A material of the pressure roller 160 may be heat resistance resin or rubber, such as another kind of fluororubber and fluororesin. To improve a abrasion resistance and a releasability of the heating roller, a surface of the heating roller 160 is coated with resin, such as PTFE, PFA, FEP, or rubber, and may also be a mixture of them. To prevent heat dissipation, the pressure roller 160 is preferably made of a material having low heat conduction.

Figure 14:
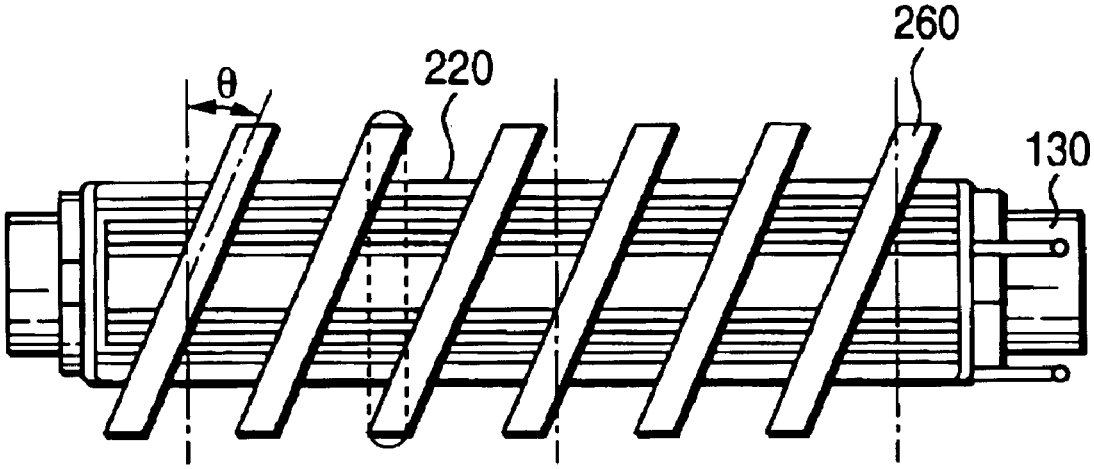
FIG. 14 is an diagram showing an arrangement of a C-shaped coil cores.
Figure 15:
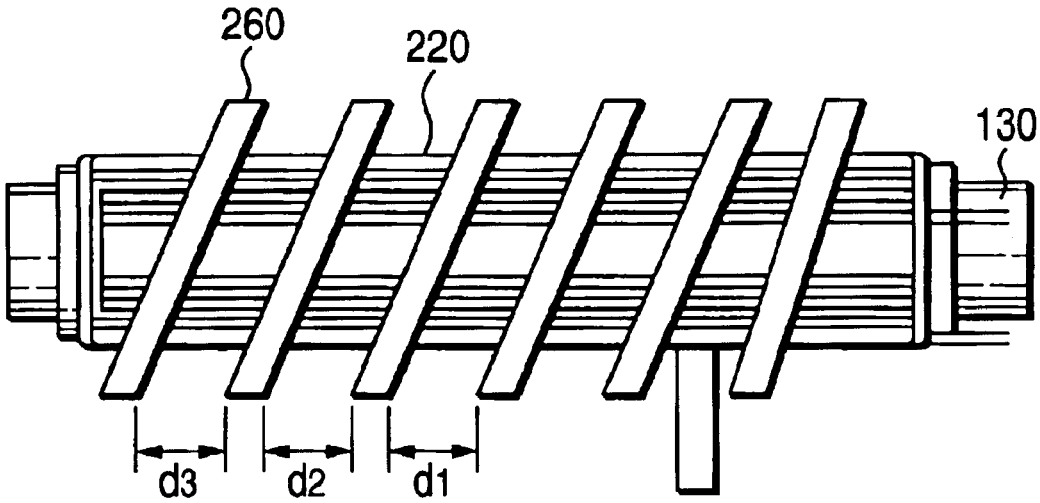
FIG. 15 is an diagram showing an arrangement of a C-shaped coil cores.

Next, FIGS. 14 and 15 show examples of an arrangement of the C-shaped coil core 260.

FIG. 14 show an example of an arrangement of the C-shaped coil cores 260. In FIG. 14, C-shaped coil cores 260 are slanted at a certain angle θ with respect to a orthogonal direction to a rotary shaft direction of the heating roller 130. According to this arrangement, magnetic fluxes developed from the exciting coil 220 are passed through the heating roller 130 along the C-shaped coil cores 260, that is, the magnetic fluxes are passed with the angle θ with respect to the orthogonal direction to the rotary shaft direction of the heating roller 130. Therefore, when the heating roller 130 is rotated, Joule heat is generated all over the heating roller 130 with respect to the rotary shaft direction. Accordingly, the heating roller 130 can be uniformly heated with respect to the rotary shaft direction.

FIG. 15 shows another example of an arrangement of the C-shaped coil cores 260. According to this arrangement, intervals between the C-shaped coil cores 260 are varied with respect to the rotary shaft direction of the heating roller 130. In FIG. 15, the C-shaped coil cores 260 are arranged, for example, at the intervals d1=21 mm, d2=21 mm and d3=18 mm, i.e., d1=d2>d3. That is, an interval between the adjacent C-shaped coil cores 260 at the end portion of the heating roller 130 is smaller than an interval between the adjacent C-shaped coil cores 260 at the center portion of the heating roller 130.

Hence, number of magnetic fluxes generated by current flowing the exciting coil 220 in the end portion of the heating roller 130 is larger than that in the center portion of the heating roller 130. This results a heating value is large at the end portion of the heating roller 130. On the other hand, at the end portion of the heat roller 130, heat is easily drawn therefrom by a thermal conduction to a shaft bearing etc., as compared with the center portion of the heat roller 130. Accordingly, the above effects are counteracted, then uniform temperature distribution of the heating roller and the heat resistance belt is obtained, thereby failure of the image fixing is prevented.

As described above, in the embodiments, a heating part of an IH fuser is covered with a support frame made of resin or the like. A sheet metal is provided covering the support frame. The sheet metal prevents the support frame from being warped. A short ring is provided, and prevents unnecessary radiation by small leaking flux leaking to outside from the rear side of the core and the like, thereby suppressing noise generation in other members or devices, or the short ring supplements the support-frame warping prevention effect by the metal sheet.

As seen from the foregoing description, a short ring and a shielding plate are provided near an exciting coil of a heating device or a fuser, which is based on the electromagnetic induction. Accordingly, unnecessary radiation by slight leaking fluxes leaking from the exciting coil to outside is prevented, and noise generation in other members or devices is suppressed.

Further, heat from the inside of the induction heating unit is radiated from the holes formed in the housing. Accordingly, the temperature rise of the exciting coil provided in the induction heating unit is prevented, and thus preventing insulation failure.

What is claimed is:

1. A fuser comprising:

a heating rotation member to be heated by induction current;

a support frame disposed to face at least a part of the heating rotation member;

an exciting coil which is wound on the support frame and from which magnetic fluxes is developed to generate the induction current; and a warpage prevention unit for preventing the warpage of the support frame caused by heat, wherein the warpage prevention unit comprises a first magnetic shield member disposed to face at least a part of the exciting coil and having a ring shape to prevent a leaking flux from the exciting coil, a second magnetic shield member having a ring shape to prevent a leaking flux from the exciting coil, wherein the support frame comprises a first face and a second face opposite the first face, wherein the exciting coil is wound on the first face, wherein the heat rotation member is provided to face the second face, and, wherein the first shield member is disposed over the first face, and the second shield member is disposed over the second face.

2. A heating device comprising:

a heating rotation member to be heated by induction current;

an exciting coil which is disposed to face at least a part of the heating rotation member and from which a magnetic flux is developed to generate the induction current; and a first magnetic shield member disposed in a vicinity of the exciting coil and having a ring shape to prevent a leaking flux from the exciting coil;

a second magnetic shield member disposed in a vicinity of the exciting coil and having a ring shape to prevent a leaking flux from the exciting coil, wherein the first magnetic shield member prevents a leaking flux developed in a first direction from the exciting coil, and wherein the second magnetic shield member prevents a leaking flux developed in a second direction from the exciting coil.

3. The heating device according to claim 2, wherein the heating rotation member is a heating roller including magnetic metal.

4. The heating device according to claim 2, wherein the exciting coil is wound to have substantially rectangular shape, wherein the first magnetic shield member is shaped along the rectangular shape of the exciting coil.

5. The heating device according to claim 2, wherein the exciting coil is wound to have substantially rectangular shape, wherein the first magnetic shield member and the second magnetic shield member are shaped along the rectangular shape of the exciting coil, respectively.

6. The heating device according to claim 2, wherein the first magnetic shield member includes aluminum.

7. The heating device according to claim 2, wherein the first magnetic shield member and the second magnetic shield member includes aluminum, respectively.

8. The heating device according to claim 2, wherein the first magnetic shield member includes copper.

9. The heating device according to claim 2, wherein the first magnetic shield member and the second magnetic shield member includes copper, respectively.

10. The heating device according to claim 2, further comprising a plurality of coil cores to cover the exciting coil, wherein the coil cores are arranged at an interval in a rotary shaft direction of the heating rotation member.

11. The heating device according to claim 10, wherein each of the coil cores is slanted at an angle with respect to the orthogonal direction to the rotary shaft direction of the heating rotation member.

12. The heating device according to claim 10, wherein the coil cores are arranged at different intervals, and an interval between coil cores in an end portion of the heating rotation member is smaller than an interval between coil cores in a center portion of the heating rotation member with respect to the rotary shaft direction.

13. The fuser according to claim 1, wherein the warpage prevention unit further comprises the second magnetic shield member.

14. A fuser comprising a heating device, wherein the heating device comprising:

a heating rotation member to be heated by induction current;

an exciting coil which is disposed to face at least a part of the heating rotation member and from which magnetic fluxes is developed to generate the induction current; and a first magnetic shield member disposed in a vicinity of the exciting coil and having a ring shape to prevent a leaking flux from the exciting coil; and, a magnetic shield plate disposed to cover the first magnetic shield member to prevent a leaking flux from the exciting coil.

15. The fuser according to claim 14, wherein the heating device further comprises a second magnetic shield member disposed in a vicinity of the exciting coil and having a ring shape to prevent a leaking flux from the exiting coil, wherein the first magnetic shield member prevents a leaking flux in a first direction from the exciting coil, wherein the second magnetic shield member prevents a leaking flux in a second direction from the exciting coil.

16. The fuser according to claim 15, further comprising a magnetic shield plate disposed to cover the first magnetic shield member to prevent a leaking flux from the exciting coil.

17. The fuser according to claim 14, wherein the exciting coil is wound to have substantially rectangular shape having a peripheral surface, wherein the first magnetic shield member is shaped along the peripheral surface of the exciting coil.

18. The fuser according to claim 17, further comprising a magnetic shield plate disposed to cover the first magnetic shield member to prevent a leaking flux from the exciting coil.

19. The fuser according to claim 15, wherein the exciting coil is wound to have substantially rectangular shape, wherein the first magnetic shield member and the second magnetic shield member are shaped along the rectangular shape of the exciting coil, respectively.

20. The fuser according to claim 19, further comprising a magnetic shield plate disposed to cover the first magnetic shield member to prevent a leaking flux from the exciting coil.

21. A fuser comprising:

a heating rotation member to be heated by induction current;

an exciting coil which is disposed to face at least a part of the heating rotation member and which develops magnetic fluxes to generate the induction current; and a housing disposed on a side opposite to the heating rotation member with respect to the exciting coil to cover the heating rotation member and the exciting coil, and having holes to discharge heat from the exciting coil.

22. The fuser according to 21, further comprising a air sending unit to introduce air inside the housing through the holes.

* * * * *

UNITED STATES PATENT AND TRADEMARK OFFICE

CERTIFICATE OF CORRECTION

PATENT NO. : 6,849,838 B2
DATED : February 1, 2005
INVENTOR(S) : Shimizu et al.

It is certified that error appears in the above-identified patent and that said Letters Patent is hereby corrected as shown below:

Column 10,
Line 8, after "according", please insert -- to an embodiment of the invention. In the figure the short --.

Signed and Sealed this

Thirty-first Day of May, 2005

JON W. DUDAS
*Director of the United States Patent and Trademark Office*